US007493715B2

(12) United States Patent
D'Halluin et al.

(10) Patent No.: US 7,493,715 B2
(45) Date of Patent: Feb. 24, 2009

(54) SCROLLING POSTER DISPLAY DEVICE

(75) Inventors: Marc D'Halluin, Neauphle le Chateau (FR); Christophe Lemancel, Mere (FR)

(73) Assignee: JCDecaux SA (FR)

( * ) Notice: Subject to any disclaimer, the term of this patent is extended or adjusted under 35 U.S.C. 154(b) by 0 days.

(21) Appl. No.: 11/912,023

(22) PCT Filed: Apr. 14, 2006

(86) PCT No.: PCT/FR2006/000833

§ 371 (c)(1),
(2), (4) Date: Oct. 19, 2007

(87) PCT Pub. No.: WO2006/111646

PCT Pub. Date: Oct. 26, 2006

(65) Prior Publication Data

US 2008/0236004 A1 Oct. 2, 2008

(30) Foreign Application Priority Data

Apr. 22, 2005 (FR) ..... 05 04094

(51) Int. Cl.
*G09F 11/18* (2006.01)

(52) U.S. Cl. ..... 40/471; 40/518

(58) Field of Classification Search ..... 40/471, 40/478, 518

See application file for complete search history.

(56) References Cited

U.S. PATENT DOCUMENTS

| | | | | |
|---|---|---|---|---|
| 2,563,580 | A * | 8/1951 | Clark | 40/518 |
| 3,605,301 | A * | 9/1971 | Jacquot et al. | 40/471 |
| 3,616,554 | A | 11/1971 | Singer et al. | |
| 3,726,031 | A * | 4/1973 | Singer | 40/471 |
| 3,780,458 | A * | 12/1973 | Jacoby et al. | 40/471 |
| 4,372,071 | A * | 2/1983 | Vicino | 40/624 |
| 4,707,938 | A | 11/1987 | Carssow | |
| 5,174,055 | A | 12/1992 | Aiken | |
| 5,465,515 | A | 11/1995 | Walieddine | |
| 5,940,999 | A | 8/1999 | Harruff et al. | |
| 2004/0139635 | A1 * | 7/2004 | McKinley | 40/454 |

FOREIGN PATENT DOCUMENTS

| | | |
|---|---|---|
| EP | 1 052 613 A2 | 11/2000 |
| FR | 2 786 595 | 6/2000 |
| FR | 2 812 750 | 2/2002 |
| GB | 2 256 075 A | 11/1992 |

OTHER PUBLICATIONS

Preliminary French Search Report FR 0504094; report dated Aug. 11, 2005.

International Search Report PCT/FR2006/000833; report dated Aug. 11, 2006.

* cited by examiner

*Primary Examiner*—Gary C Hoge
(74) *Attorney, Agent, or Firm*—Miller, Matthias & Hull

(57) ABSTRACT

The invention concerns a scrolling poster display device, comprising two parallel rolls, a poster strip wound on the rolls and a support device for supporting the rear side of the poster strip between the rolls. The support device comprises an air chamber delimited by a peripheral frame and a base offset rearward, and an air blowing device generates an excess pressure of air in the air chamber.

10 Claims, 3 Drawing Sheets

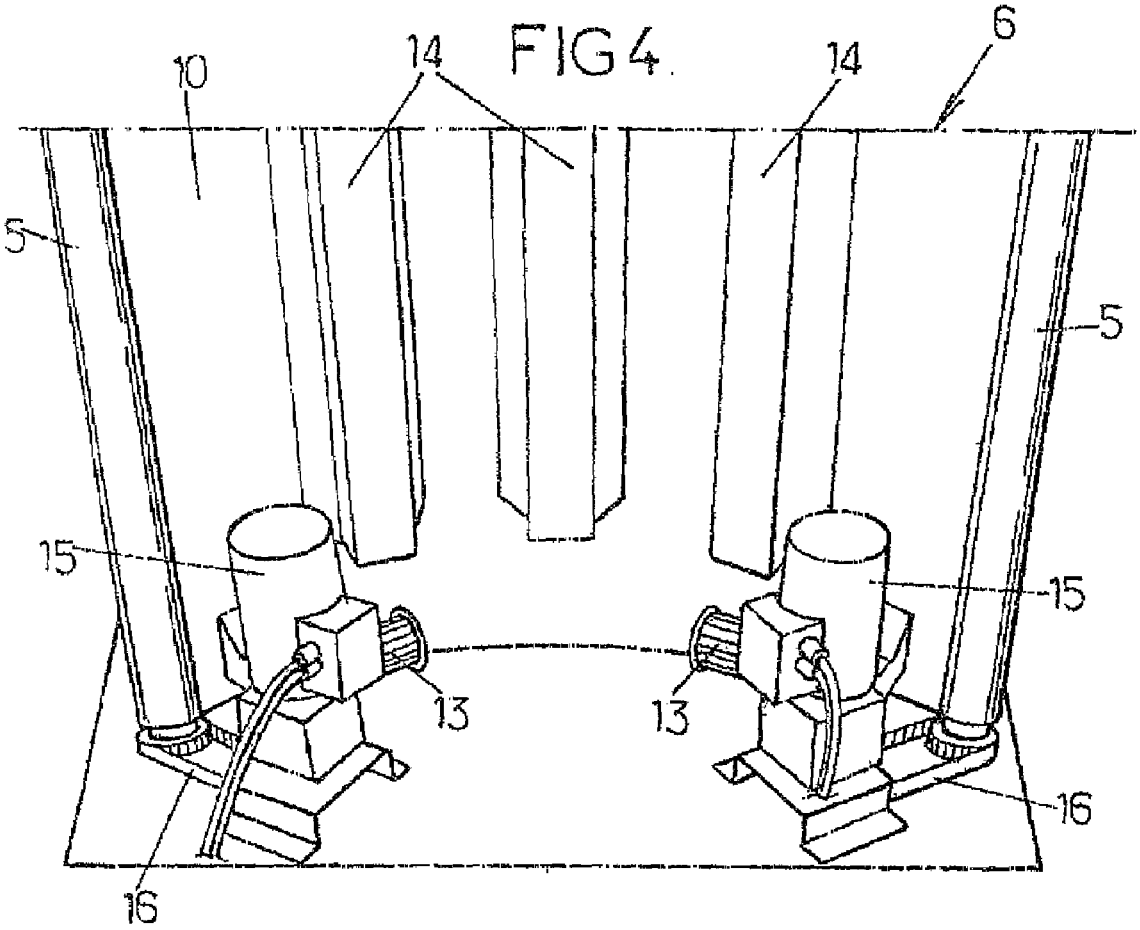
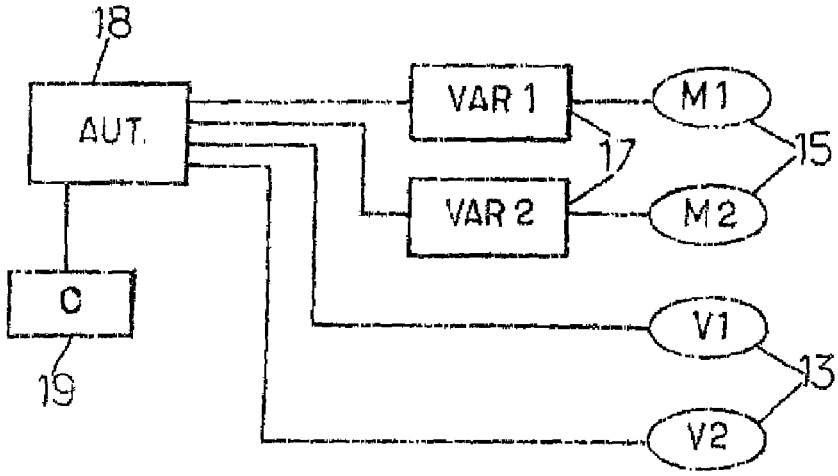
FIG 5.

SCROLLING POSTER DISPLAY DEVICE

FIELD OF THE DISCLOSURE

The present invention relates to scrolling poster display devices.

More specifically, the invention relates to a scrolling poster display device comprising:

at least two parallel rollers, poster strip wound onto the rollers, said poster strip having a front face visible to the public and a rear face on the opposite side to the front face, at least one motor for driving the rollers, and a fixed support device designed to shape the rear face of the poster strip between said rollers.

BACKGROUND OF THE DISCLOSURE

Document U.S. Pat. No. 5,174,055 describes a display device of this type, in which the rear face of the poster strip rests against a solid support panel which extends over the entire surface of this poster and in particular allows the poster to be given a curved shape. This display device has the following disadvantages in particular:

the rubbing of the posters or of their support strip against the bearing panel may wear and/or soil the posters or their support strip, this rubbing generates static electricity which causes the posters to adhere to the bearing panel, thus impeding the correct scrolling of the posters and possibly even causing them to tear.

SUMMARY OF THE DISCLOSURE

To this end, according to the invention, the support device comprises an air chamber delimited by a peripheral surround adjacent to the rear face of the poster strip and a back which is offset rearward with respect to the surround, said support device comprising no element near the rear face of the poster strip inside the surround, and the display device further comprises at least one air-blowing device able to create a raised air pressure in the air chamber, the air injected into the air chamber escaping to the exterior thereby forming a layer of air at the interface between the surround and the rear face of the poster strip.

By virtue of these measures, the poster strip is filled with the blown air, giving it a shape corresponding to the shape of the surround. In addition, practically all contact between the rear face of the poster strip and the support device is avoided because of the creation of a layer of air between the surround and the poster strip. The aforementioned disadvantages of the prior art are thus avoided.

In some preferred embodiments of the invention recourse may also possibly be had to one and/or other of the following measures:

the poster strip is substantially impervious to air;

the poster strip is kept under tension;

the poster strip is kept under tension by the rollers;

the rollers are substantially vertical;

the surround comprises two opposite first sides substantially perpendicular to the rollers, which have a convex overall shape with the bulge facing forward so that the poster strip itself exhibits a convex shape with the bulge facing forward between the rollers;

the two first sides of the surround have identical shapes;

the two first sides of the surround each have a front face adjacent to the rear face of the poster strip, of width of between 5 and 12 cm;

the surround also comprises two second sides substantially parallel to the rollers, said second sides each having a rounded front edge;

the display panel comprises an electronic control unit which controls the rollers and which is designed to release the tension in the poster strip partially when said poster strip is set in motion by the rollers.

Other features and advantages of the invention will become apparent in the course of the following description of an embodiment thereof, given solely by way of nonlimiting example with reference to the attached drawings,

BRIEF DESCRIPTION OF THE DRAWINGS

In the drawings:

FIG. 4 is a perspective view from the rear of the poster support of FIG. 2; and FIG. 5 is a block diagram of the display device of FIG. 1.

DETAILED DESCRIPTION

In the various figures, the same references denote elements which are identical or similar.

Figure 1:
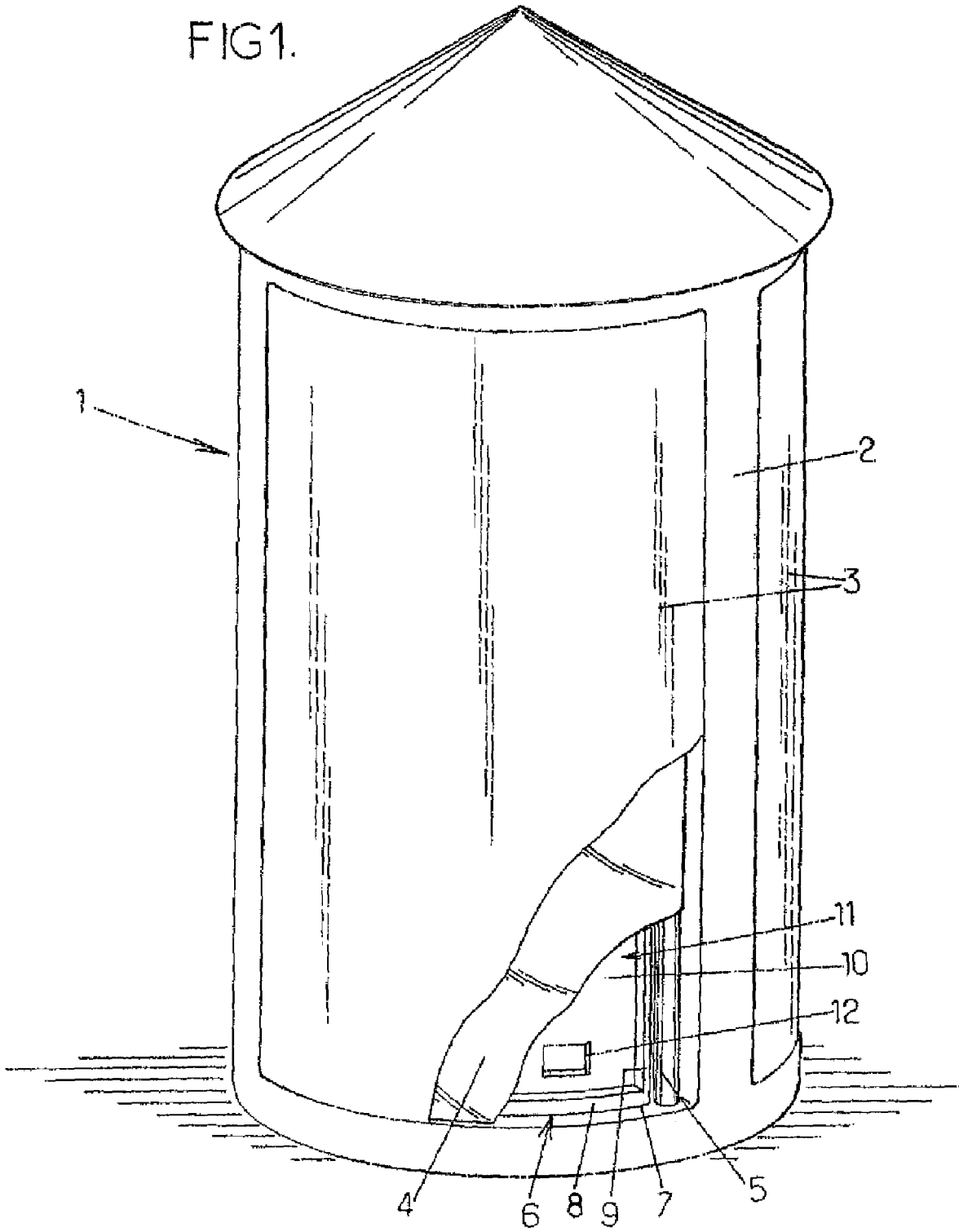
FIG. 1 is a perspective view of a display device according to one embodiment of the invention.

FIG. 1 depicts a display device 1 consisting, for example, of a pillar of cylindrical overall shape comprising a support structure 2, fixed to the ground, and optically transparent windows 3, for example, in the form of portions of a cylinder.

Posters belonging to a scrolling poster strip 4 are displayed in each window 3.

The poster strip 4 is wound onto two parallel rollers 5, for example vertical rollers, just one of which can be seen in FIG. 1.

These rollers are motor driven and are controlled by an electronic control unit as described in greater detail hereinafter, so that the posters that form the poster strip 4 can scroll past in sequence so that each of these posters can be displayed in turn in the window 3.

Between the rollers 5 there is a poster support device 6, fixed to the support structure 2, and which is designed to support the rear face of the poster strip 4, that is to say that face of this poster strip that is not visible to the public.

Figure 2:
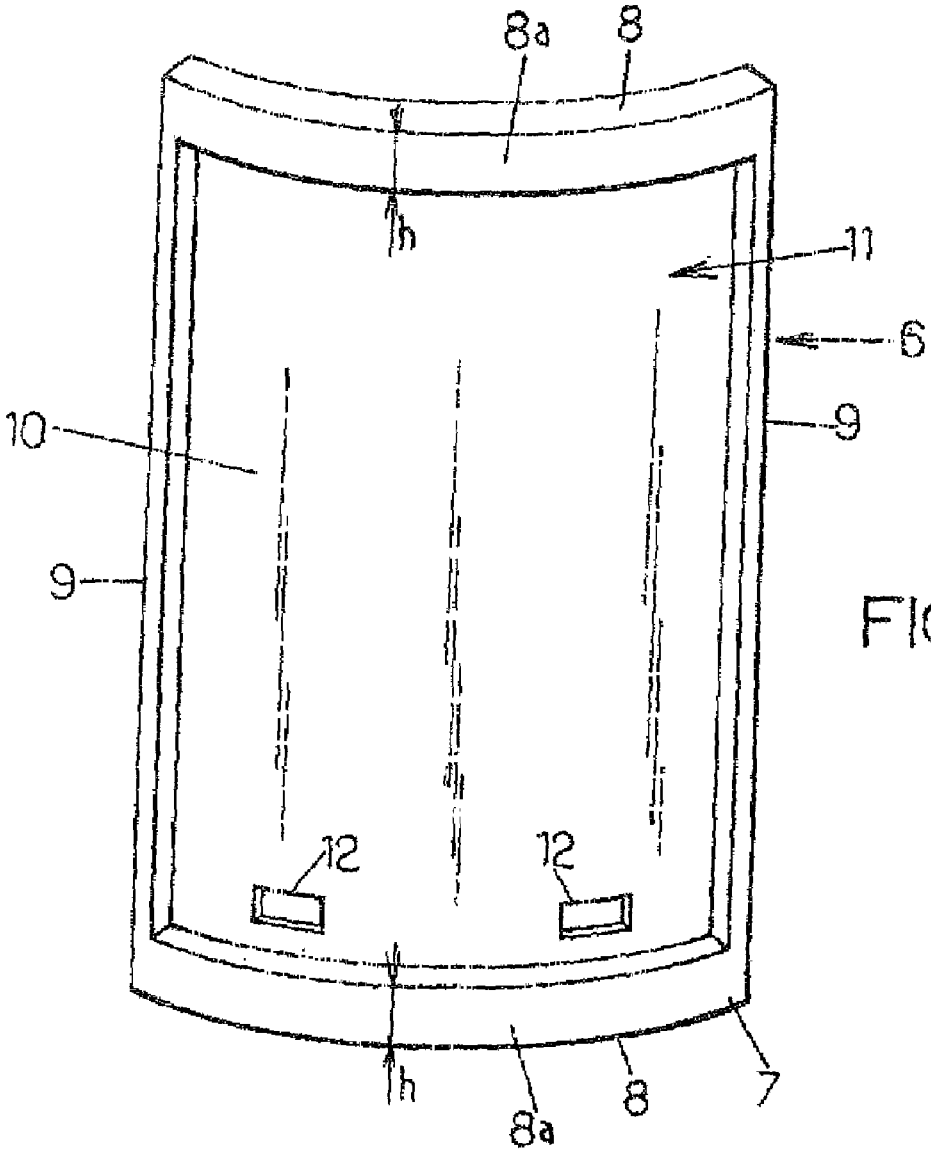
FIG. 2 is a perspective view from the front, of a poster support belonging to the display device of FIG. 1.
Figure 3:
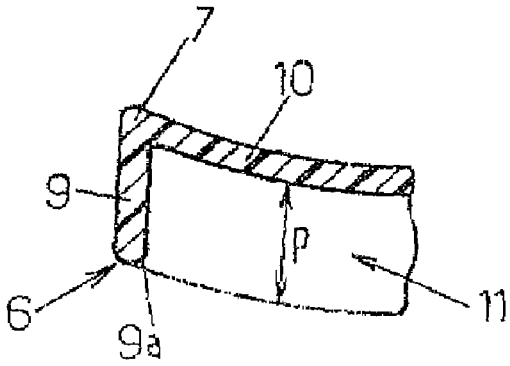
FIG. 3 is a partial view in horizontal section of the poster support of FIG. 2.

As can be seen in FIGS. 1 to 3, this support device 6 has the overall shape of a portion of a cylinder of vertical axis and with the bulge facing toward the outside of the display device, that is to say forward.

More specifically, this support device 6 comprises a surround 7 which comprises:

two horizontal first sides 8, these being an upper side and a lower side respectively, in the overall form of arcs of a circle, and two straight and vertical second sides 9.

Each of the first sides 8 has a front face 8*a* in the form of a portion of a cylinder, which is adjacent to the rear face of the poster strip 4 and which has a width h in the vertical direction. This width h ranges, for example, between 5 and 12 cm and may in particular be of the order of 10 cm.

Furthermore, each of the second sides 9 comprises a front edge 9*a* (see FIG. 3) which is adjacent to the rear face of the poster strip 4 and which may be relatively thin, for example having a width ranging between 5 and 10 mm, This front edge 9*a* is preferably of rounded cross section, as can be seen in FIG. 3.

The support device 6 further comprises a back 10 which may advantageously be produced as a single piece with the surround 7, for example in translucent Plexiglas® or the like The back 10 has the overall shape of a section of a cylinder and may itself have a thickness ranging for example between 5 and 10 mm. The back 10 is positioned set back rearward from the front faces 8*a* and from the front edges 9*a* of the surround, in order together with the surround 7 to delimit an air chamber 11 of depth P ranging for example between 2 and 4 cm, and for example of the order of 3 cm.

Formed in the back 10 of the poster support 6 are one or more openings 12 each of which communicates with a blower 13 situated behind the back 10, as depicted in FIG. 4. Each of the blowers 13 constantly blows air into the air chamber 11 in order to create a slight raised pressure, for example of the order of 20 to 30 Pa, therein. This raised pressure "fills" the poster strip opposite the air chamber 11 and gives it a cylindrical shape corresponding to the overall shape of the support device 6.

In addition, this raised pressure creates a small air leak around the entire periphery of the support device 10, between the surround 7 and the rear face of the poster strip 4, especially since the poster strip is generally made of a material that is substantially impervious to air. This leak creates a permanent layer of air separating the rear face of the poster strip 4 from the support device 6, thereby avoiding or, at the very least, limiting, rubbing between said rear face of the poster strip and the support device 6

As can be seen in FIG. 4, illuminating devices 14, for example fluorescent tubes, may also be fixed to the rear face of the back 10 so as to back-light the poster while it is being displayed through said back 10, which is preferably translucent Moreover, electric motors 15, for example asynchronous motors, may also be housed behind the back 10, each of these driving one of the rollers 5 via a transmission device, for example a belt 16.

These motors can be controlled for example as described in document FR-A-2 812 750, using two variators 17 (VAR1, VAR2) visible in FIG. 5, controlled by an electronic control unit 18 (AUT) such as an industrial controller or the like When the poster strip 4 is scrolled horizontally in order to change the poster being displayed, the poster strip is tensioned slightly as power is supplied to the motor of the roller driving the rolled poster strip at a frequency slightly higher than the other roller Advantageously, the controller 18 may be designed:

so that this tension is relatively slight during the scrolling movement (corresponding, for example, to a frequency difference of 1 to 2 Hz across the variators 17), and to increase this tension when the poster strip stops.

As can be seen in FIG. 5, the controller 18 may also control the blowers 13 (V1, V2) and may also be connected to a sensor 19 (C), known per se, designed to detect identifiers on the poster strip so that the scrolling of this strip is halted in correspondence with the posters that it bears.

The invention claimed is:

1. A scrolling poster display device comprising:

at least two parallel rollers, a poster strip wound onto the rollers, said poster strip having a front face visible to the public and a rear face on the opposite side to the front face, at least one motor for driving the rollers, and a fixed support device designed to shape the rear face of the poster strip between said rollers, wherein the support device comprises an air chamber delimited by a peripheral surround adjacent to the rear face of the poster strip and a back which is offset rearward with respect to the surround, said support device comprising no element near the rear face of the poster strip inside the surround, and wherein the display device further comprises at least one air-blowing device able to create a raised air pressure in the air chamber, the air injected into the air chamber escaping to the exterior thereby forming a layer of air at the interface between the surround and the rear bee of the poster strip.

2. The display device as claimed in claim 1, in which the poster strip is substantially impervious to air.

3. The display device as claimed in claim 1, in which the poster strip is kept under tension.

4. The display device as claimed in claim 3, in which the poster strip is kept under tension by the rollers.

5. The display device as claimed in claim 4, comprising an electronic control unit which controls the rollers and which is designed to release the tension in the poster strip partially when said poster strip is set in motion by the rollers.

6. The display device as claimed in claim 1, in which the rollers are substantially vertical.

7. The display device as claimed in claim 1, in which the surround comprises two opposite first sides substantially perpendicular to the rollers, which have a convex overall shape with the bulge facing forward so that the poster strip itself exhibits a convex shape with the bulge facing forward between the rollers.

8. The display device as claimed in claim 7, in which the two first sides of the surround have identical shapes.

9. The display device as claimed in claim 7, in which the two first sides of the surround each have a front face adjacent to the rear face of the poster strip, said front face having a width comprised between 5 and 12 cm.

10. The display device as claimed in claim 7, in which the surround also comprises two second sides substantially parallel to the rollers, said second sides each having a rounded front edge.

* * * * *